US011781741B2

(12) United States Patent
Scholz

(10) Patent No.: US 11,781,741 B2
(45) Date of Patent: Oct. 10, 2023

(54) HEADLIGHT

(71) Applicant: Ledlenser GmbH & Co. KG, Solingen (DE)

(72) Inventor: Ulrich Scholz, Ratingen (DE)

(73) Assignee: Ledlenser GmbH & Co. KG, Solingen (DE)

( * ) Notice: Subject to any disclaimer, the term of this patent is extended or adjusted under 35 U.S.C. 154(b) by 0 days.

(21) Appl. No.: 17/921,388

(22) PCT Filed: May 20, 2021

(86) PCT No.: PCT/DE2021/100448
§ 371 (c)(1),
(2) Date: Oct. 26, 2022

(87) PCT Pub. No.: WO2021/254560
PCT Pub. Date: Dec. 23, 2021

(65) Prior Publication Data

US 2023/0184414 A1 Jun. 15, 2023

(30) Foreign Application Priority Data

Jun. 16, 2020 (DE) ..... 10 2020 115 781.9

(51) Int. Cl.

| | |
|---|---|
| ***F21V 21/084*** | (2006.01) |
| ***F21V 21/08*** | (2006.01) |
| ***F21L 4/00*** | (2006.01) |
| *F21Y 115/10* | (2016.01) |

(52) U.S. Cl.
CPC ..... *F21V 21/084* (2013.01); *F21L 4/00* (2013.01); *F21V 21/0816* (2013.01); *F21Y 2115/10* (2016.08)

(58) Field of Classification Search
CPC ..... F21V 21/084; F21V 21/0816; F21L 4/00; F21Y 2115/10
See application file for complete search history.

(56) References Cited

U.S. PATENT DOCUMENTS

| | | | | |
|---|---|---|---|---|
| 4,984,724 | A * | 1/1991 | Johnston | F21L 15/14 362/108 |
| 5,412,811 | A * | 5/1995 | Hildenbrand | A61B 90/50 2/418 |
| 9,759,419 | B1 * | 9/2017 | Rothschild | F21V 23/001 |
| 2009/0323317 | A1 | 12/2009 | Spartano et al. | |
| 2014/0336472 | A1 * | 11/2014 | Ferguson | F21V 21/084 600/249 |

(Continued)

FOREIGN PATENT DOCUMENTS

| | | | |
|---|---|---|---|
| DE | 19518898 | A1 | 11/1996 |
| DE | 10037036 | A1 | 3/2001 |

(Continued)

*Primary Examiner* — Evan P Dzierzynski
(74) *Attorney, Agent, or Firm* — McGlew and Tuttle, P.C.

(57) ABSTRACT

A headlight (forehead light) includes a housing (10) for accommodating a light-emitting device, in particular at least one LED, and a further housing (11) for accommodating at least one battery or rechargeable battery (15). The housings (10, 11) are connected to one another by a conductor (16) suitable for voltage and current supply and are secured to a strap. The strap has an elastic and a non-elastic part (12, 13). The conductor (16) is integrated into the non-elastic part (12).

20 Claims, 3 Drawing Sheets

(56) References Cited

U.S. PATENT DOCUMENTS

| | | | | |
|---|---|---|---|---|
| 2015/0345760 | A1* | 12/2015 | Law | F21V 21/08 362/105 |
| 2017/0276856 | A1 | 9/2017 | Gagneux | |
| 2018/0058680 | A1* | 3/2018 | Berrel | F21V 21/145 |
| 2020/0003400 | A1 | 1/2020 | Kelly | |
| 2020/0248896 | A1* | 8/2020 | Gall | F21V 21/084 |

FOREIGN PATENT DOCUMENTS

| | | | |
|---|---|---|---|
| EP | 2481981 | B1 | 4/2014 |
| EP | 3293451 | A1 | 3/2018 |
| WO | 2008091931 | A1 | 7/2008 |

* cited by examiner

HEADLIGHT

CROSS REFERENCE TO RELATED APPLICATIONS

This application is a United States National Phase Application of International Application PCT/DE2021/100448, filed May 20, 2021, and claims the benefit of priority under 35 U.S.C. § 119 of German Application 10 2020 115 781.9, filed Jun. 16, 2020, the entire contents of which are incorporated herein by reference.

TECHNICAL FIELD

The invention relates to a headlight (also known as a forehead light or head lamp) with a housing for accommodating a light source, in particular at least one LED, and a further housing for accommodating at least one battery or accumulator, the two housings being connected to one another via a conductor suitable for supplying voltage and power and being fastened to a strap.

BACKGROUND

Headlights are used, for example, by craftsmen, speleologists or runners. Such headlights have the advantage compared to flashlights that they do not have to be carried in one hand, so that both hands are free for work or other activities. The carrier band, which is preferably elastic, is used to attach the light sources, which are arranged in the middle of the forehead, so that when the head is pivoted, the lamps shine in the direction in which the headlamp wearer is looking. In order to prevent the lamp housing from becoming too large and too heavy when a battery or an accumulator is accommodated, the headlamps have an accumulator housing which is arranged diametrically opposite the lamp housing. This achieves a balanced distribution of mass, which the wearer of the headlamp finds comfortable. For electricity or power supply, the conductors (power cables) must be arranged between the two housings. The power line is attached to the headband, for example, by means of retaining clips, or alternatively, as described, for example, in DE 19518898 A1, incorporated into the band fabric in the form of metal strands. However, this embodiment variant has the disadvantage that there is a risk of a line break in the mostly elastic band, which renders the headlamp inoperable. The option proposed as an alternative in this document, to form the band as a hose band and arranging the power line in the inner cavity, does protect the power cable against external mechanical damage, but the power conductor must assume a meandering position when the band is relaxed, which then completely or partially is dissolved under tensile stress. As a result, not only frictional forces are exerted onto the conductors or the headband inside, which can lead to premature wear, but also the wearing comfort is worsened.

In this regard, DE 10037036 A1 proposes designing the band to be easily and quickly exchangeable by appropriately forming slots on the housing.

As shown and described in EP 2 481 981 B1, for example, electrical connecting lines are designed as spiral lines that are attached to at least one point on the headband, for example by a clip. Although the spiral shape allows friction-free changes in length of the conductor when the band is stretched, the conductor protrudes beyond the headband, which means that the conductor can easily get caught in other objects during use or transport. Such entanglement when running in a branch or twig can result not only in damage to the headlamp, but also in injury to the headlamp wearer.

SUMMARY

It is therefore the object of the present invention to create an integration of the conductor into the headband in a simple and cost-effective manner without restricting the ease of use and wearing comfort. In particular, a great freedom of design of the headlight shape should be made possible and the risk of getting caught in other objects should be prevented.

This object is achieved by a headlight according to the invention, which is characterized in that the band has an elastic and a non-elastic part and that the conductor is integrated in the non-elastic part. Because the conductor is integrated in the non-elastic part of the strap, it is protected from tensile loads and other frictional forces both when putting on the strap and when carrying or removing the strap, since the length of the strap can be adjusted to the shape of the wearer's head exclusively via the "other band part" (elastic band part). The conductor can be enclosed in the non-elastic part, for example by co-extrusion of a plastic.

The conductor is preferably arranged in a hollow space in the non-elastic part of the band or is encased by the material of the non-elastic band part, so that the conductor is protected against external mechanical or chemical influences.

In order to be able to form the lamp in a balanced way, the non-elastic and the elastic part of the band have essentially the same length and each form half of the band, so that the lamp is on the front side and the battery/accumulator housing is on the back of the wearer's head.

According to a further embodiment, the non-elastic part of the strap is flexible, which offers the advantage that this part of the strap can also be adapted to the shape of the head or clings to the shape of the head when worn.

As known in principle from the state of the art, the strap is designed to be adjustable in length, primarily at the ends of the elastic and non-elastic part or in the elastic part via a buckle arranged there, so that different diameter sizes of the strap can be adjusted in the unloaded state. The adjustment to the head size of the wearer can be designed individually for optimal wearing comfort.

According to a further embodiment of the invention, the strap and/or the battery/accumulator housing and/or the lamp housing is provided with foam padding on the inside, i.e. on the side facing the wearer's head. These pads prevent the band or the housing from chafing on the scalp.

According to a further embodiment of the invention, the battery/accumulator housing and/or the lamp housing is provided with eyelets, which are used to feed through and hold the strap. Because of these eyelets the strap can be easily detached from the lamp housing and accumulator/battery housing when tape cleaning or replacement is required.

According to a further embodiment of the invention, the strap has reflectors on the outside, which can be designed in the form of points or stripes. Such reflectors are particularly advantageous for runners, who can be more easily recognized by motorists from all sides in traffic.

An embodiment of the present invention is illustrated in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
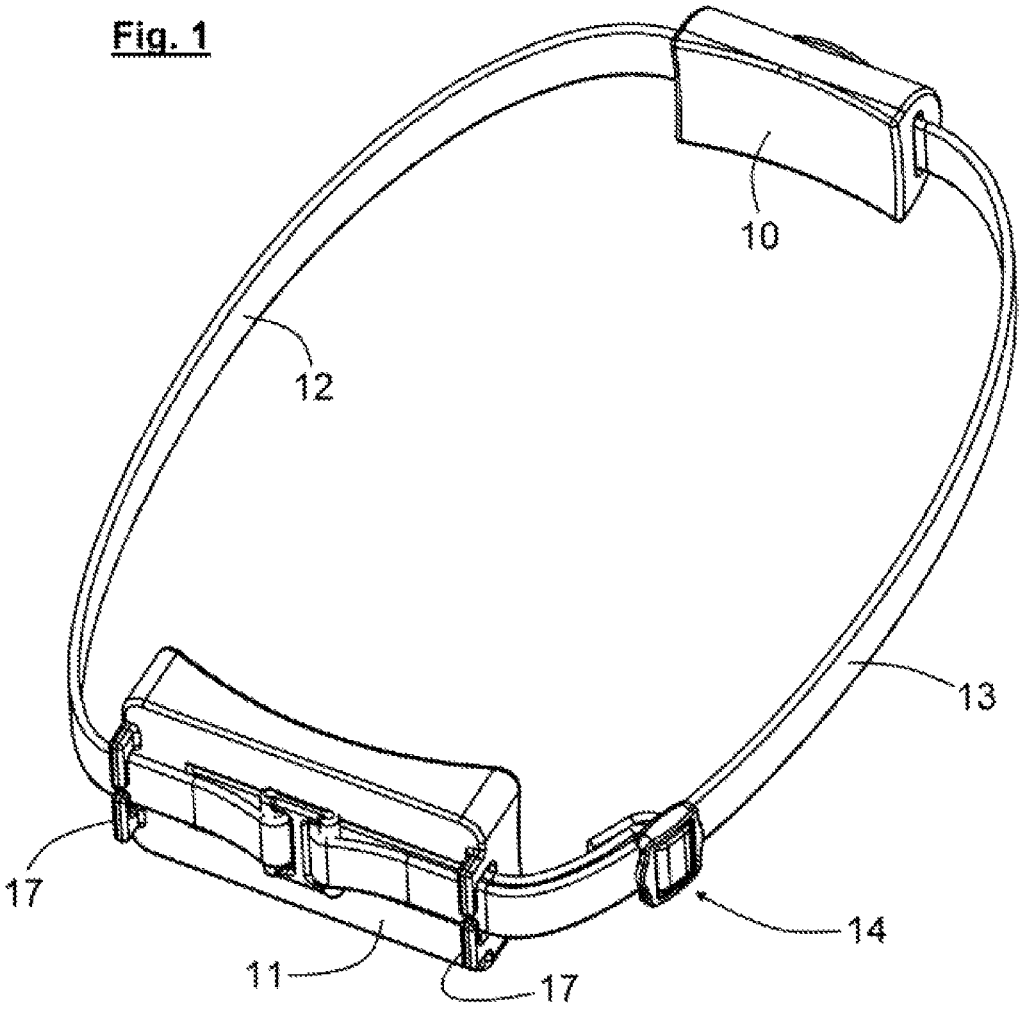
FIG. 1 is a perspective view of the headlight according to the invention.
Figure 2:
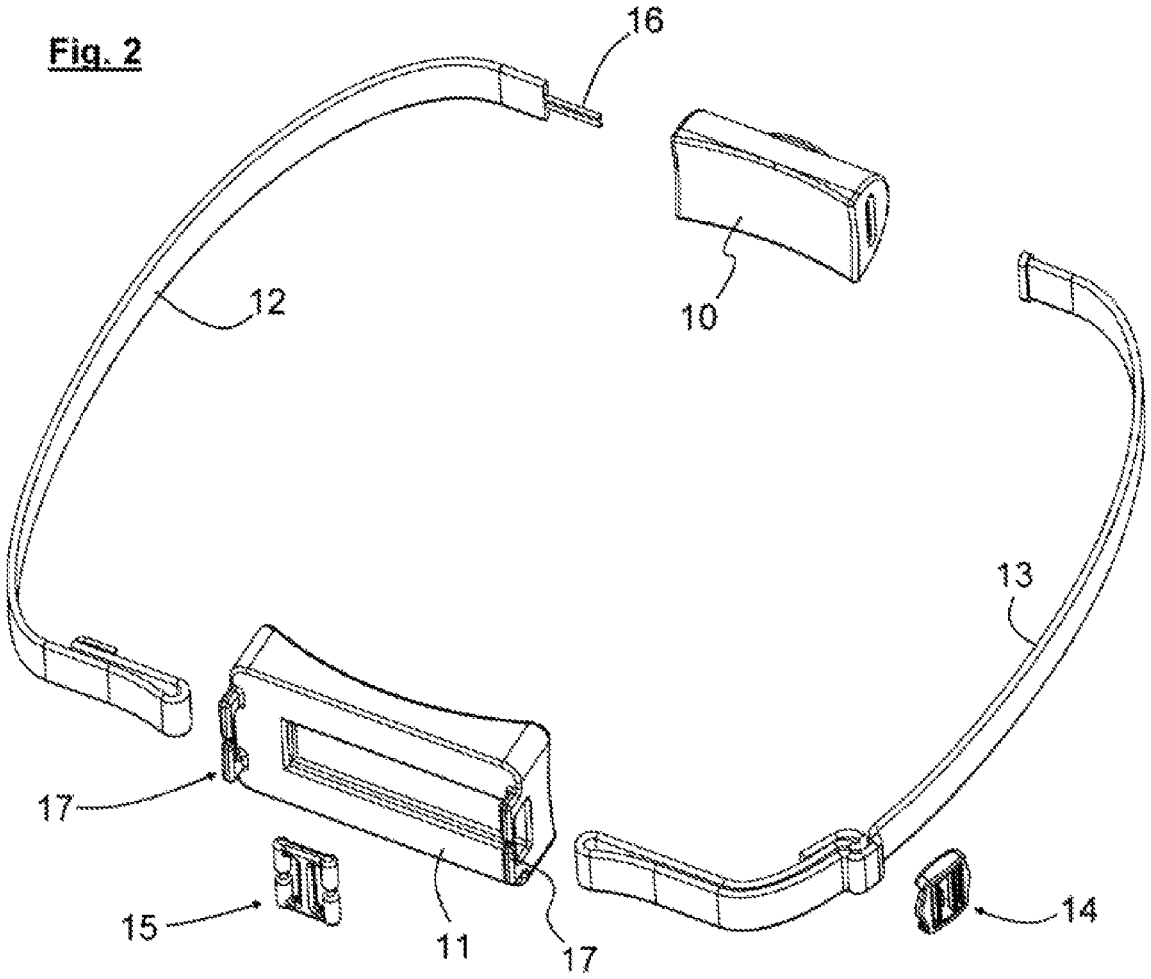
FIG. 2 is an exploded view of the headlight of FIG. 1.
Figure 3:
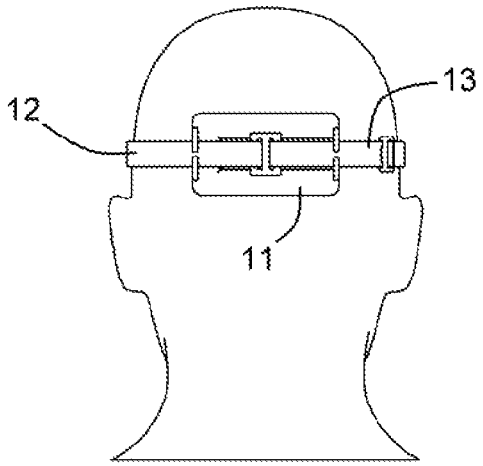
FIG. 3, FIG. 4, FIG. 5 and FIG. 6 are different views of a headlight according to FIG. 1, placed on the head.
Figure 4:
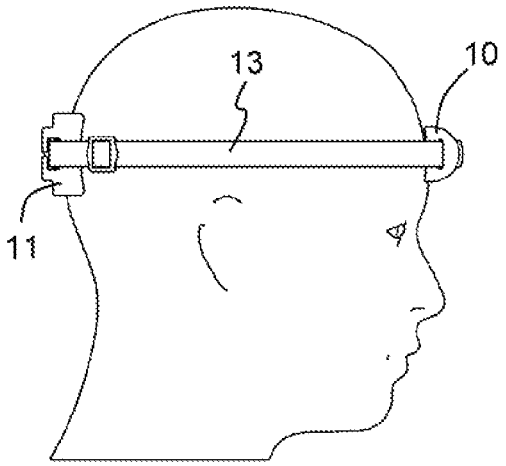
Figure 5:
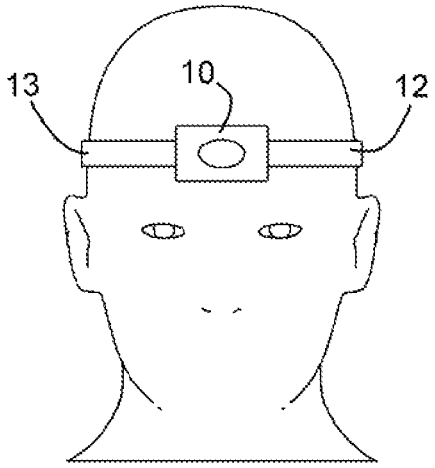
Figure 6:
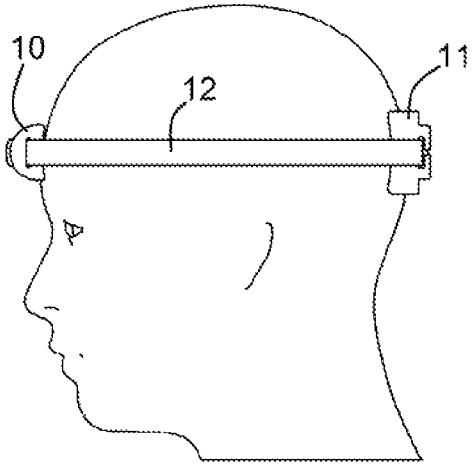

Referring to the drawings, the core components of a headlight are the lamp housing 10 and the battery/accumulator housing 11, which are connected to one another by a band consisting of the band parts 12, 13.

At least one LED and corresponding control and adjustment elements are contained in the lamp housing. The on/off switch for the headlight can be located either on the lamp housing or on the battery/accumulator housing. The same applies to the brightness controller or pulse sequencer, which, e.g. can be used in the twilight when the lamp holder should to be recognized from a great distance, but utilization of the lamp is otherwise not intended.

In order to ensure a powerful and/or long-term power supply, several batteries or accumulators 15 are usually used as a voltage source, which are arranged in a separate housing that can be replaced and which, for reasons of carrying comfort, is diametrically opposite to the lamp housing 10 is arranged. In the case shown, the strap parts 12, 13 are approximately the same length, with the strap part 12 being flexible but inelastic. This part 12 contains the integrated conductor 16 for the current, this conductor being either woven into a textile band or cast into a flexible plastic band part. Due to the non-elastic design of this part 12 of the band, the conductor is in any case secured against tensile loads.

In the present case, the housings 10 and 11 for the lamps or the batteries or accumulators have eyelets or tape feed-through openings. A buckle 14 is provided in the area of the elastic part 13 of the strap, which allows the length of the elastic head strap part to be adjusted, which is known in principle from the prior art and serves to adjust the entire strap 12, 13 to the desired head diameter (in the unloaded state). The inside of the housing 10, 11 can optionally be provided with a foam.

While specific embodiments of the invention have been shown and described in detail to illustrate the application of the principles of the invention, it will be understood that the invention may be embodied otherwise without departing from such principles.

The invention claimed is:

1. A headlight comprising:

a housing for accommodating a light source;

a further housing for accommodating at least one battery or accumulator;

a strap; and a conductor, both housings being connected to each other via the conductor, the conductor being configured to supply voltage and power and being attached to the strap, wherein the strap has an elastic and a non-elastic part and that the conductor is completely and exclusively integrated in the non-elastic part.

2. A headlight according to claim 1, wherein the conductor is arranged in a cavity of the non-elastic part of the strap.

3. A headlight according to claim 2, wherein the non-elastic part and the elastic part of the strap are substantially of a same length and each form essentially half of a headband comprised by the strap.

4. A headlight according to claim 2, wherein the non-elastic part of the strap is flexible.

5. A headlight according to claim 2, wherein a length of the strap is configured to be adjustable.

6. A headlight according to claim 2, further comprising foam padding, wherein the strap and/or the battery/accumulator housing and/or the light source housing are attached to the foam padding.

7. A headlight according to claim 2, wherein the battery/accumulator housing and/or the light source housing have eyelets configured to receive and hold the strap.

8. A headlight according to claim 2, further comprising reflectors arranged on the strap.

9. A headlight according to claim 2, wherein the light source comprises an LED.

10. A headlight according to claim 2, wherein:

the non-elastic part and the elastic part of the strap form at least a part of a headband; and the headband includes a buckle configured to adjust a length of the strap.

11. A headlight according to claim 1, wherein the non-elastic part and the elastic part of the strap are of substantially the same length and each form half of a headband comprised by the strap.

12. A headlight according to claim 1, wherein the non-elastic part of the strap is flexible.

13. A headlight according to claim 1, wherein the length of the strap is adjustable.

14. A headlight according to claim 1, wherein the strap and/or the battery/accumulator housing and/or the light source housing have foam padding.

15. A headlight according to claim 1, wherein the battery/accumulator housing and/or the light source housing have eyelets for passing through and holding the strap.

16. A headlight according to claim 1, further comprising reflectors arranged on the strap.

17. A headlight according to claim 1, wherein the light source comprises an LED.

18. A headlight according to claim 1, wherein:

the non-elastic part and the elastic part of the strap form at least a part of a headband; and the headband includes a buckle configured to adjust a length of the strap.

19. A headlight comprising:

a housing for accommodating a light source;

a further housing for accommodating at least one battery or accumulator;

a conductor configured to supply voltage and power from the at least one battery or accumulator accommodated by the further housing to the light source accommodated by the housing; and a headband comprising a strap connecting the housing to the further housing, wherein the strap has an elastic part extending from the further housing to the light source and a non-elastic part extending with a fixed length from the further housing to the light source, wherein the conductor is completely and exclusively integrated in the non-elastic part.

20. A headlight according to claim 19, wherein:

the non-elastic part is flexible but inelastic;

the length of the strap is adjustable exclusively via the elastic part, whereby the conductor that is completely and exclusively integrated in the non-elastic part is protected from tensile loads and other frictional forces both when putting on the strap and when carrying or removing the strap as the length of the strap is adjusted to a shape of the wearer's head exclusively via the elastic part.

* * * * *